US005479689A

United States Patent [19]

Schmit et al.

[11] Patent Number: 5,479,689

[45] Date of Patent: Jan. 2, 1996

[54] WINDSHIELD EXPANSION TOOL AND METHOD FOR REMOVING VEHICLE WINDSHIELDS

[75] Inventors: David E. Schmit, Eden Prairie; Bobby W. Sanders, Jr., Rosemount; James H. Lundquist, Bloomington, all of Minn.

[73] Assignee: Harmon Glass Company, Minneapolis, Minn.

[21] Appl. No.: 248,873

[22] Filed: May 24, 1994

[51] Int. Cl.[6] ..... B23P 19/02

[52] U.S. Cl. ..... 29/426.4; 29/426.5; 29/239; 81/302; 81/485

[58] Field of Search ..... 29/426.4, 426.5, 29/239; 269/6; 81/302, 314, 329, 342, 346, 352, 353, 354, 355, 356, 485

[56] References Cited

U.S. PATENT DOCUMENTS

| | | | |
|---|---|---|---|
| 1,863,897 | 6/1932 | Cloppert | 29/426.5 |
| 1,869,244 | 7/1932 | Gabler . | |
| 2,014,535 | 9/1935 | Maca | 29/239 |
| 2,430,996 | 11/1947 | Rush . | |
| 3,426,752 | 2/1969 | Laico . | |
| 3,705,581 | 12/1972 | Drake . | |
| 4,199,852 | 4/1980 | Ayers et al. . | |
| 4,443,001 | 4/1984 | Haerer . | |
| 5,048,795 | 9/1991 | Vitale . | |

*Primary Examiner*—David P. Bryant
*Attorney, Agent, or Firm*—Dorsey & Whitney

[57] ABSTRACT

A windshield replacement tool which can be selectively inserted between the top edge of the windshield and the vehicle frame during replacement for the purpose of separating the windshield and maintaining such separation during the removal process. The method aspect of the present invention relates to the use of the tool for windshield replacement while minimizing stresses on the head, neck, back, shoulders and arms during the replacement process.

19 Claims, 2 Drawing Sheets

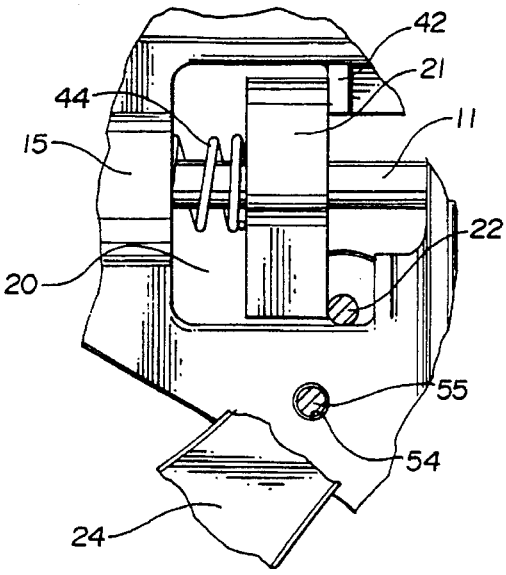
Fig. 3
Fig. 4
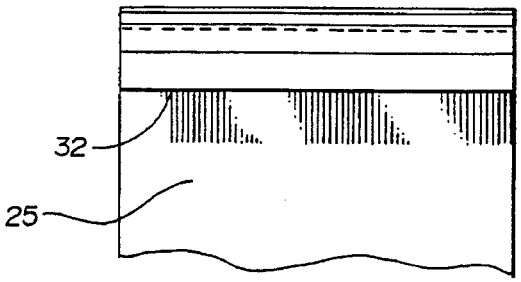
Fig. 5
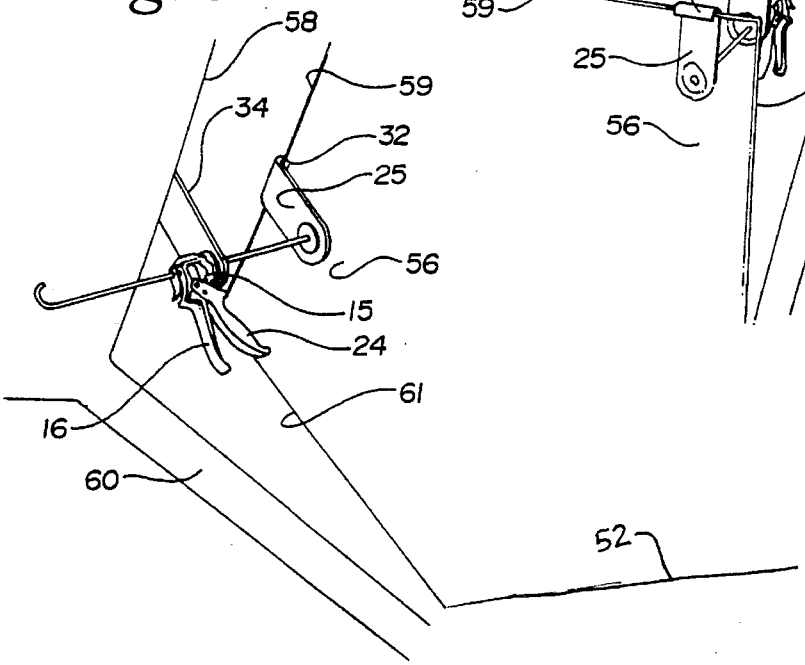
Fig. 6
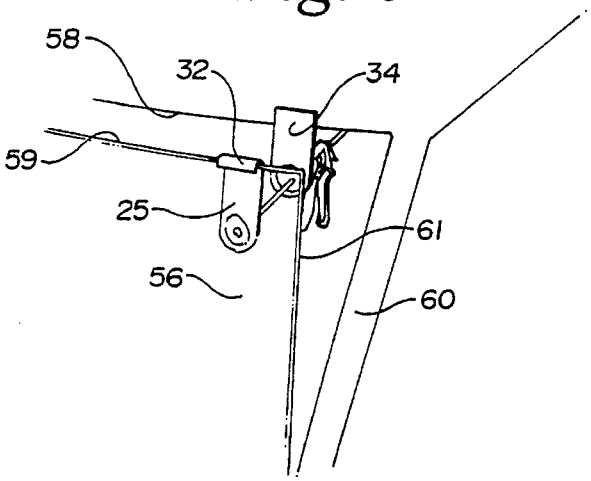

WINDSHIELD EXPANSION TOOL AND METHOD FOR REMOVING VEHICLE WINDSHIELDS

BACKGROUND OF THE INVENTION

1. Field of the Invention

The present invention relates generally to a windshield expansion tool and method for removing windshields from vehicles and more particularly to a windshield expansion tool and method which facilitates removal of a windshield from an automobile or the like for replacement purposes while substantially reducing, if not eliminating, head, neck, back, shoulder and arm injuries which commonly result from such activity.

2. Description of the Prior Art

Injuries to the head, neck, back, shoulders and arms occur frequently when removing a vehicle windshield for replacement. A vehicle windshield having top, bottom and side edges is secured to a vehicle by seals between such edges and corresponding top, bottom and side vehicle frame members. Specifically the top windshield edge is connected to a top vehicle frame member via a pinch weld seal, the side windshield edges are connected to the side vehicle frame members or pillar posts and the bottom edge is connected to a bottom vehicle frame member.

A common vehicle windshield replacement procedure involves first cutting the seal from inside of the vehicle along the top and edges of the windshield. When this is completed, the seal along the bottom edge of the windshield is cut from the inside. However, cutting the seal along the lower edge of the windshield from the inside is extremely difficult unless the windshield is lifted away from the top and side frame members. Further, there is an increased tendency to damage the vehicle dash area if the windshield is not pulled away from the top and side frame members while the bottom edge seal is being cut. Because of this, windshield replacement personnel often use their head, neck, back, shoulders and arms to move the top and side edges of the windshield away from the corresponding vehicle frame members, while cutting the seal along the bottom edge with a free hand. This places great stress on the head, neck, back, shoulders and arms and has led to a large number of injuries and thus injury compensation claims.

Accordingly, there is a need in the art for a windshield replacement tool and method by which vehicle windshields can be removed and replaced quickly, efficiently and with minimal stresses on the head, neck, back, shoulders and arms of the replacement personnel.

SUMMARY OF THE INVENTION

In contrast to the prior art, the present invention provides a windshield replacement tool in the form of a windshield expansion tool which is designed for placement between the top edge of the windshield and the top vehicle frame member after the top and side seals have been cut. The tool is then used to separate the top and side windshield edges from their corresponding vehicle frame members and to retain such separation while the bottom seal is being cut. More specifically, the tool of the present invention includes a pair of jaws adapted for placement between the windshield top edge and the top frame member and a means for separating the jaws to cause the windshield to be separated from the vehicle frame.

The method aspect of the present invention includes cutting the top and side seals between the top and side windshield edges and their corresponding vehicle frames, inserting the jaws of a windshield expansion tool between the top edge of the windshield and its frame and then expanding the jaws to separate the top edge of the windshield from the top frame. The seal along the bottom edge of the windshield is then cut while maintaining the above separation.

Accordingly, it is an object of the present invention to provide an improved tool and method for replacing vehicle windshields.

Another object of the present invention is to provide a tool and method for replacing windshields which substantially reduces, if not eliminates head, neck, back, shoulder and arm injuries resulting from manually maintaining separation between the windshield and the vehicle frame while simultaneously cutting the bottom seal.

Another object of the present invention is to provide a tool and method for windshield replacement which is quick and efficient.

These and other objects of the present invention will become apparent with reference to the drawings, the description of the preferred embodiment and the appended claims.

DESCRIPTION OF THE DRAWINGS

FIG. 3 is an enlarged fragmentary view with portions broken away showing engagement between the trigger lever and the rod advancement pawl.

FIG. 4 is an elevational front view of the upper portion of the moveable expansion jaw.

FIG. 5 is a perspective view from inside the vehicle showing the tool of the present invention being used to expand or separate a vehicle windshield from the vehicle frame during a windshield replacement process.

FIG. 6 is a perspective view, similar to FIG. 5 except that it is viewed from outside the vehicle.

DESCRIPTION OF THE PREFERRED EMBODIMENT

Figure 1:
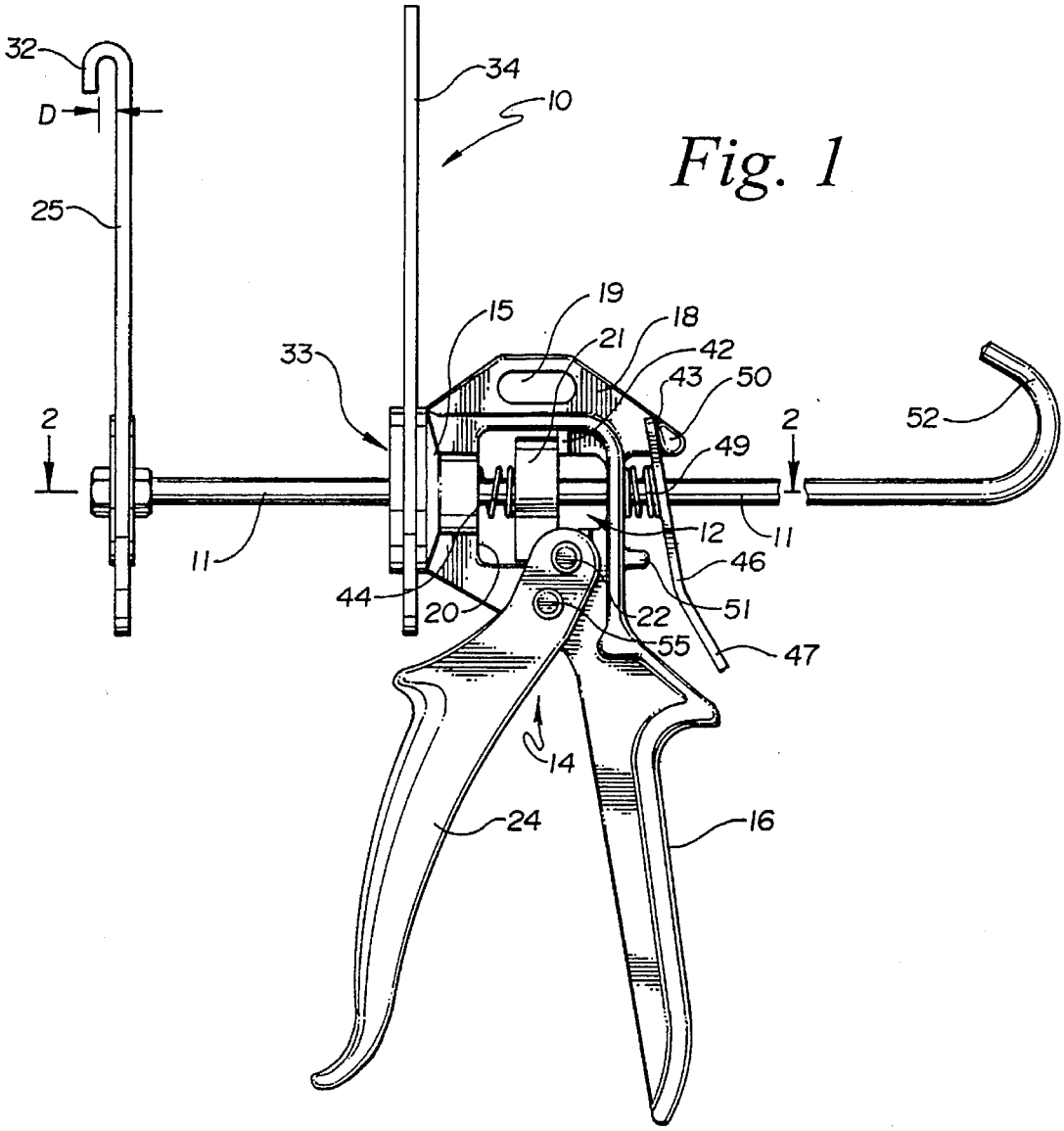
FIG. 1 is an elevational side view of the windshield expansion or separation tool in accordance with the present invention.
Figure 2:
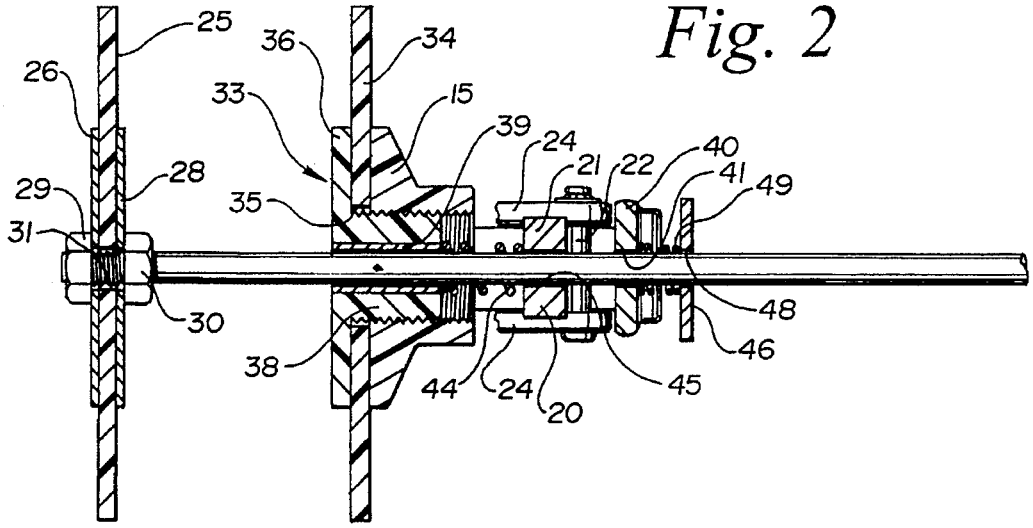
FIG. 2 is a view, partially in section, as viewed along the section line 2—2 of FIG. 1.

Reference is first made to FIGS. 1, 2 and 3 showing the windshield expansion and replacement tool of the present invention. In general, as illustrated best in FIG. 1, the tool includes a jaw assembly 10 comprised of a pair of jaws 25 and 34 and a rod advancement assembly 12 for selectively advancing and retracting an advancement rod 11 with a trigger assembly 14. The tool further includes a body 15, a downwardly extending handle 16 integrally formed with the body 15 and a top hanger bracket 18 having an opening 19 for hanging the tool when not in use. A central opening 20 in the body 15 provides access to a rod advancement pawl 21 and facilitates advancing engagement between a force exerting pin 22 and the rod advancement pawl 21 as shown in FIG. 3.

As shown best in FIG. 2, the elongated advancement rod 11 extends through the body 15 and is connected at its forward end to a forward or moveable jaw 25. The rod 11 is threaded at its forward end and extends through an opening 31 in the jaw 25. The jaw 25 is connected to the rod 11 as a result of being sandwiched between a pair of washers 26 and 28 and a pair of threaded lock nuts 29 and 30.

The top end of the forward jaw 25 is provided with a means for selectively connecting such jaw 25 to, or suspending such jaw 25 from, the top edge of the windshield which is being removed. In the preferred embodiment, this means includes an outwardly extending hook 32 which is of a size sufficient to be positioned over the upper edge of the windshield as shown in FIGS. 5 and 6. As shown best in FIG. 4, the hook portion of the preferred embodiment extends across the entire width of the forward jaw 25. However, this is not a requirement. Further, the preferred embodiment shows the hook 32 as being integrally formed with the jaw 25. Again, this is not an absolute requirement. The means for connecting or suspending the forward jaw 25 from the top edge of the windshield can be separately connected with the jaw 25 and can comprise any bracket, hook or other similar member which performs the function of suspending or connecting the jaw 25 from the windshield edge. Preferably the distance "d" between the distal end of the hook 32 and the forward surface of the jaw 25 is slightly larger than the thickness of a vehicle windshield. This enables the hook 32 to be slipped over the top edge of the windshield as will be described in further detail below.

A rearward or fixed jaw 34 is generally aligned with the forward jaw 25, is positioned rearwardly of the jaw 25 and is rigidly secured to the tool body 15. Preferably the jaw 34 is longer than the jaw 25. As shown best in FIG. 2, the jaw 34 includes an opening 35 near its lower end and is secured to the tool body 15 as a result of being sandwiched between a portion of the tool body 15 and a flange portion 36 of a lock member 33. The lock member 33 further includes a rearwardly extending cylindrical section 38 having external threads for mating with internal threads of the body 15. An internal cylindrical opening formed in the center of the lock member 33 has a diameter slightly larger than the other diameter of the rod 11 to assist in guiding movement of the rod 11 through the tool body 15. The jaws 25 and 34 can be constructed front a variety of materials including metal, metal alloys and plastics, among others. In the preferred embodiment, however, the jaws 25 and 34 are constructed of a plastic such as polycarbonate.

Although the preferred embodiment shows the forward jaw 25 embodying means in the form of the hook 32 for connection to the windshield, the present invention also contemplates that the connection means could be provided on the fixed or rearward jaw and that such connection means could be designed to connect with, or be suspended from, the top vehicle frame rather than from the top windshield edge.

A rearward portion of the tool body 15 includes a portion 40 having a cylindrical guide opening 41 (FIG. 2) for supporting and guiding the rod 11. In the preferred embodiment, the portion 40 and its guide opening 41 is spaced rearwardly from the forward guide opening 39. Rod advancement means in the form of the rod advancement pawl 21 is provided in the opening 20 between the guide openings 39 and 41. The pawl 21 has a rod receiving opening 45 slightly larger than the outer diameter of the rod 11. As illustrated best in FIG. 3, the pawl 21 includes an upper, rearward surface adapted for engagement with a stop member 42 and a lower rearward surface for engagement by the trigger advancement pin 22. The forward surface of the pawl 21 is engaged by bias means in the form of the coil spring 44. The spring 44 has one end engaging the rearward end of the section 38 and its other end engaging the forward surface of the pawl 21. The spring 44 continually biases the pawl 21 against the stop member 42 and the pin 22.

With the above structure, initial movement of the pin 22 toward the left as viewed in FIG. 3 causes a slight clockwise rotation of the pawl 21. This causes the edges of the pawl opening 45 to tightly engage the outer surface of the rod 11 so that further forward movement of the pin 22 causes corresponding forward movement of pawl 21 and thus the rod 11 and the connected moveable jaw 25. When force from the pin 22 is released, the pawl 21 is moved rearwardly by the spring 44 against the stop 42 rod 11 is maintained in its advanced position by the rod release member 46 as described below.

The rod release member 46 is positioned rearwardly of the section 40 and functions to allow free forward movement of the rod through an opening 48 (FIG. 2), but which selectively prevents or allows rearward movement of the rod 11 through the opening 48. The rod release member 46 includes an upper end 43 engaging a stop member 50 which limits rearward movement of the release member 46 and also provides a pivot against which the upper end 43 may pivot. The lower end of the rod release member 46 is provided with a thumb release end 47 for selectively moving the member 46 forward into engagement with the stop 51. Bias means in form of the coil spring 49 functions to bias the member 46 rearwardly against the stop 50. The structure of the member 46 including the size of the opening 48 is such that when the member 46 is moved into engagement with the stop 51, the rod 11 is allowed to move freely through the opening 48 (FIG. 2) in both a forward and rearward direction. However, when the member 46 is biased rearwardly by the spring 49 into the position illustrated in FIG. 1, rearward movement of the rod 11 through the opening 48 is precluded. Forward movement of the rod 11 through the opening 48 will still be permitted provided a sufficient forward force is exerted on the rod 11. The magnitude of the force necessary to move the rod in a forward direction is directly related to the force of the spring 49. In a preferred embodiment, the magnitude of the spring 49 is such that the force of the spring 49 can be easily overcome when the rod is advanced via the rod advancement pawl 21 and the trigger 24.

The rearward end of the rod 11 is provided with a hook 52. The hook 52 enables the rod 11 to be manually gripped and pulled rearwardly through the tool body 15 when the rod release member 46 is depressed and retraction of the forward jaw 25 is desired.

The trigger assembly 14 for advancing the rod advancement pawl 21 includes a handle 16 integrally formed with the tool body 15 and a trigger lever 24 pivotally secured to a lower portion of the body 15 about the pivot 55. The pivot 55 in turn is mounted within the pivot opening 54 (FIG. 3) in the body 15.

With the above structure, the jaws 25 and 34 can be selectively moved away from or forward one another. Repeated depression of the trigger lever 24 causes advancement of the pawl 21 and thus corresponding advancement of the rod 11 and separation of the jaws 25 and 34. During this advancement, rearward movement of the rod 11 is prevented by the member 46. When it is desired for the jaws 25 and 34 to be moved toward one another, the end 47 is depressed. This releases the gripping force exerted by the member 46 and allows the rod 11 and thus the jaw 25 to be moved rearwardly.

Having described the structure of the windshield replacement tool of the present invention, its operation and the method aspect of the present invention can be understood best with reference to FIGS. 5 and 6 as follows. As shown in FIGS. 5 and 6, the windshield 56 includes a side edge 61, a top edge 59 and a bottom edge 52. When installed, the side edge 61 is connected in sealed relationship to the pillar post or side frame member 60 of the vehicle, the top edge 59 is connected in sealed relationship to the top vehicle frame 58 and the bottom edge 62 is connected in sealed relationship to a bottom vehicle frame adjacent to the vehicle dash 64.

The initial step in removing and replacing a vehicle windshield in accordance with the present invention is to cut the top edge 59 and the side edge 61 of the windshield from inside the vehicle. Next, the top edge 59 is manually separated from the top frame 58 a sufficient distance to insert the upper ends of the jaws 25 and 34. Once inserted, the hook portion 32 of the forward jaw 25 is hooked over the top edge 59 of the windshield. The trigger 24 is then repeatedly manually depressed. This causes movement of the jaw 25 away from the jaw 34, thus separating the top edge 59 from the frame 58 as shown in FIGS. 5 and 6. When there is sufficient separation, the seal between the bottom edge 62 and the bottom frame can be cut. While the bottom seal is being cut, the tool maintains separation between the top edge 59 and the frame 58. During the removal process, it is contemplated that the jaws 25 and 34 of the tool can be retracted and moved to different locations along the top edge 59 of the windshield or that multiple tools can be used to provide the desired separation between the windshield and the vehicle frame.

Although the description of the preferred embodiment has been quite specific, it is contemplated that various modifications could be made without deviating from the spirit of the present invention. Accordingly, it is contemplated that the scope of the present invention be dictated by the appended claims rather than by the description of the preferred embodiment.

We claim:

1. A windshield expansion tool for use in vehicle windshield replacement comprising:

a pair of corresponding expansion jaws selectively moveable toward and away from one another between a closed position and an expanded position;

one of said jaws having connection means for connecting said one jaw to the windshield to be replaced; and jaw movement means for selectively moving said pair of jaws between said closed and expanded positions.

2. The windshield expansion tool of claim 1 wherein said jaws are aligned with one another and are moveable between a closed position in which said jaws are closely adjacent to one another and an expanded position in which said jaws are spaced front one another.

3. The windshield expansion tool of claim 1 wherein said jaw movement means includes a tool body.

4. The windshield expansion tool of claims 3 wherein one of said jaws is fixed relative to said tool body and the other is moveable relative to said tool body.

5. The windshield expansion tool of claim 4 wherein said moveable jaw includes said connection means.

6. The windshield expansion tool of claim 5 wherein said connection means includes a hook portion for connection to an edge of the windshield to be replaced.

7. The windshield expansion tool of claim 6 wherein said hook portion is oriented away from said fixed jaw.

8. The windshield expansion tool of claim 4 wherein said jaw movement means includes an elongated jaw advancement rod extending through said tool body.

9. The windshield expansion tool of claim 8 wherein said rod includes a forward end and said moveable jaw is fixed to and moveable with said forward end.

10. The windshield expansion tool of claim 9 wherein said connection means includes a hook portion for connection to an edge of the windshield to be replaced.

11. The windshield expansion tool of claim 9 wherein said jaw movement means includes a manually actuated trigger assembly and said tool further includes rod advancement means for selectively moving said rod in a direction causing movement of said movable jaw toward said expanded position and rod release means for selectively moving said rod in a direction causing movement of said movable jaw toward said closed position.

12. The windshield expansion tool of claim 9 wherein said jaws are aligned with one another and each are positioned at right angles relative to said rod.

13. The windshield expansion tool of claim 12 wherein each of said jaws includes an outer end and wherein the outer end of said fixed jaw is spaced a greater distance from said rod than said moveable jaw.

14. The windshield expansion tool of claim 1 wherein said jaws are constructed of plastic.

15. A windshield expansion tool for use in vehicle windshield replacement in which the windshield to be replaced includes top, bottom and side edges sealed to corresponding top, bottom and side vehicle frame members, said tool comprising:

a pair of jaws selectively moveable toward and away from one another between a closed position and an expanded position;

one of said jaws having means for connection to one of an edge of the windshield to be replaced or a vehicle frame member and the other of said jaws being engagable with the other of the windshield to be replaced or a vehicle frame member; and means for selectively moving said pair of jaws between said closed and expanded positions to separate the windshield to be replaced from the vehicle frame in a direction substantially perpendicular to the windshield to be replaced.

16. A method of removing a vehicle windshield from a vehicle, said windshield having top, bottom and side edges, said vehicle having corresponding top, bottom and side vehicle frame members, and said windshield further having seals along said top, bottom and side edges for connecting the windshield to the top, bottom and side vehicle frame members, respectively, said method comprising the steps of:

providing a windshield expansion tool having a pair of selectively expandable jaws;

cutting the seals along said top edge and said side edges;

separating the top and side edges from the top and side frame members in a direction substantially perpendicular to the windshield to be replaced and inserting said pair of jaws between one of said top and side edges and its corresponding frame member;

expanding said jaws; and cutting the seal along said bottom edge while said jaws are expanded.

17. The method of claim 16 wherein one of said jaws includes connection means for connecting said one jaw to one of a windshield edge or a vehicle frame member and the method further includes connecting said one jaw to one of said windshield edge or a vehicle frame member.

18. The method of claim 17 wherein said connection means include a hook portion and said method includes positioning said hook portion over said top edge.

19. The method of claim 17 including connecting said one jaw to a windshield edge.

* * * * *